US007104549B2

(12) United States Patent
Eun et al.

(10) Patent No.: US 7,104,549 B2
(45) Date of Patent: Sep. 12, 2006

(54) STEERABLE INLINE SKATE

(75) Inventors: Tak Eun, Ansan-shi (KR); Sun-kyu Yang, Seoul (KR)

(73) Assignee: Microinspection Inc., (KR)

( * ) Notice: Subject to any disclaimer, the term of this patent is extended or adjusted under 35 U.S.C. 154(b) by 84 days.

(21) Appl. No.: 10/456,603

(22) Filed: Jun. 6, 2003

(65) Prior Publication Data

US 2003/0227143 A1 Dec. 11, 2003

(30) Foreign Application Priority Data

Jun. 7, 2002 (KR) ..... 10-2002-0032057
May 27, 2003 (KR) ..... 10-2003-0033741

(51) Int. Cl.
*A63C 1/34* (2006.01)

(52) U.S. Cl. ..... 280/11.28; 280/11.232; 280/11.27

(58) Field of Classification Search ..... 280/11.28, 280/11.27, 11.232, 11.231, 11.221, 11.222, 280/11.223, 11.225
See application file for complete search history.

(56) References Cited

U.S. PATENT DOCUMENTS 3,653,678 A * 4/1972 Collett ..... 280/11.225
4,402,521 A * 9/1983 Mongeon ..... 280/11.225
4,838,564 A 6/1989 Jarvis
5,183,277 A 2/1993 Tang
5,405,156 A * 4/1995 Gonella ..... 280/11.28
5,411,278 A 5/1995 Wittmann
5,486,011 A * 1/1996 Nelson ..... 280/11.207
5,582,418 A * 12/1996 Closser ..... 280/11.225
5,704,621 A * 1/1998 Lazarevich et al. ..... 280/11.28
5,816,588 A * 10/1998 Nicoletti ..... 280/11.231
5,951,027 A * 9/1999 Oyen et al. ..... 280/11.225
6,012,727 A * 1/2000 Chang ..... 280/11.28
6,161,846 A * 12/2000 Soderberg ..... 280/11.225
6,227,550 B1 * 5/2001 Maggiolo ..... 280/11.223
6,241,264 B1 6/2001 Page
6,454,280 B1 * 9/2002 Longino ..... 280/11.28

* cited by examiner

*Primary Examiner*—Jeff Restifo
(74) *Attorney, Agent, or Firm*—Fish & Richardson P.C.

(57) ABSTRACT

A steerable inline skate which allows user to change direction more easily and reduce the abrasion of wheels to thus lengthen the life of the wheels by allowing front and rear wheels 30 and 50 among a plurality of wheels arranged in a line to be steered within a predetermined angle utilizing the structure of a trapezoidal linkage.

12 Claims, 19 Drawing Sheets

STEERABLE INLINE SKATE

BACKGROUNDOF THE INVENTION

1. Field of the Invention

The present invention relates to an inline skate, and more particularly, to a steerable inline skate which makes a user change the direction more easily and reduce wheel wear to thus enhance the controllability and the service life by making front and rear wheels steerable among a plurality of wheels arranged in a line to be user by utilizing a trapezoidal linkage mechanism.

2. Description of the Related Art

In general, skates may be divided broadly into ice skates for skating on the ice and roller skates provided with wheels for obtaining the effect of doing ice skating on the ground.

The roller skates are largely divided into quad roller skates and inline skates. The quad roller skates are generally known as roller skates and consist of a skate boot commonly made of leather with two pairs of wheels bilaterally arranged at the front and back of the bottom, that is, four wheels are directly attached on a frame, being mounted to the frame in such a manner that the wheels form the vertexes of a rectangular. The wheels are located at the front and back and at the left and right. This makes it easy to keep the center of gravity of the body, so the roller skates of such a type are suitable for children or beginners.

The inline skates are also widely known as roller blades which are the name of a manufacturer and consist of a plurality of wheels rolling contacted on the ground and arranged in a single row at the front and back in a frame. Though it is difficult to keep the center of gravity of the body as compared to the quad roller skates, the inline skates can put on a higher speed and make skaters perform a greater variety of feats. By these advantages, the popularization of inline skates is currently going on with rapidity and inline skating has becoming popular as an excellent activity for leisure that people can enjoy irrespective of season and place.

FIG. 1 is a side view of a conventional inline skate and FIG. 2 is a partially sectional view taken on line A—A of FIG. 1. The inline skate generally comprises a boot 11 for receiving the foot of a user, a boot chassis 12 for supporting the boot 11 and serving as the outer coat of the boot 11, a wheel frame 13 attached to the bottom of the boot chassis 12, a plurality of wheels 14 arranged on the wheel frame 13 in a single row and a brake 15 mounted on the back end of the wheel frame 13.

At this time, a flat coupling plate 16 is provided on top portion of the wheel frame 13, with the bottom of the boot chassis 12 and the wheel frame 13 being tightly contacted and fixed respectively to the top face of the coupling plate 16 and to the bottom face thereof by a fixing member.

In the conventional inline skate thus configured, as shown in FIG. 2, the wheel 14 is mounted on the wheel frame 13 by means of a bearing 17 and an axle shaft 18 and is configured such that it is only capable of forward rotation and reverse rotation around the axle shaft 18. Therefore, in a case that the user wants to change the direction of its movement during inline skating, he has to make sideslip of the wheels to steer his skate on the ground that requires comparably high-level skill and physical strength. Even if a user is fully aware of good techniques, it is difficult to make the sideslip instantly when he runs down a hill, so he cannot easily change the direction of his movement, thereby causing a safety accident to happen.

In addition, the sideslip accelerates wear of the wheel 14 to shorten the service life of the wheel 14.

SUMMARY OF THE INVENTION

To solve the above-described problems, it is, therefore, an object of the present invention to provide a steerable inline skate which makes a user change the direction more easily even at a higher speed to thus reduce the risk of a safety accident and which lengthen the service life of its wheels by reducing wheel wear caused by the relative motion between the outer or inner curved surface of the wheels and the ground by allowing front and rear wheels among a plurality of wheels arranged in a line to be steerable within a predetermined angle by utilizing a trapezoidal linkage mechanism.

To achieve the above object, there is provided an inline skate having a plurality of wheels rolling-contacted with the ground rotatably arranged on a wheel frame in a line, comprising: a front wheel mounted on the front end of the wheel frame by first elastic supporting means extending forward and showing the behavior characteristics of a trapezoidal linkage; a rear wheel mounted on the rear end of the wheel frame in the direction opposite to the front wheel by second elastic supporting means; and pressing means for deforming the front and rear wheels in an axial direction upon moving the center of gravity of the body in order to change the direction of the inline skate.

Preferably, the first elastic supporting means and the second elastic supporting means each comprises a pair of leaf springs whose one end is fixed to the lateral surface of the wheel frame and which are extended in such a manner that the gap between the two leaf springs facing each other becomes gradually smaller and a axle shaft which is connected in parallel to the front end of the leaf springs across the gap between the facing leaf springs and on which the front and rear wheels are rotatably mounted.

More preferably, the inline skate further comprises a pair of wheel fixing plates arranged on the front end of the leaf springs for adjusting the position where the axle shaft is placed in a forward and rearward direction.

Furthermore, the first elastic supporting means and the second elastic supporting means may be comprised of a hinge bar whose opposite ends hingeably coupled to a wheel supporting unit which the lateral surface of the wheel frame and the front and rear wheels are mounted to and a tension spring connected between the wheel frame and the wheel supporting unit.

By this configuration, the front and rear wheels are steerable within a predetermined angle by the first and second elastic supporting means upon the change of the direction, for thereby making the user change the direction more easily.

BRIEF DESCRIPTION OF THE DRAWINGS

The above objects, features and advantages of the present invention will become more apparent from the following detailed description when taken in conjunction with the accompanying drawings, in which.

DETAILED DESCRIPTION OF THE PREFERRED EMBODIMENT

A preferred embodiment of the present invention will now be described with reference to the accompanying drawings.

Figure 1:
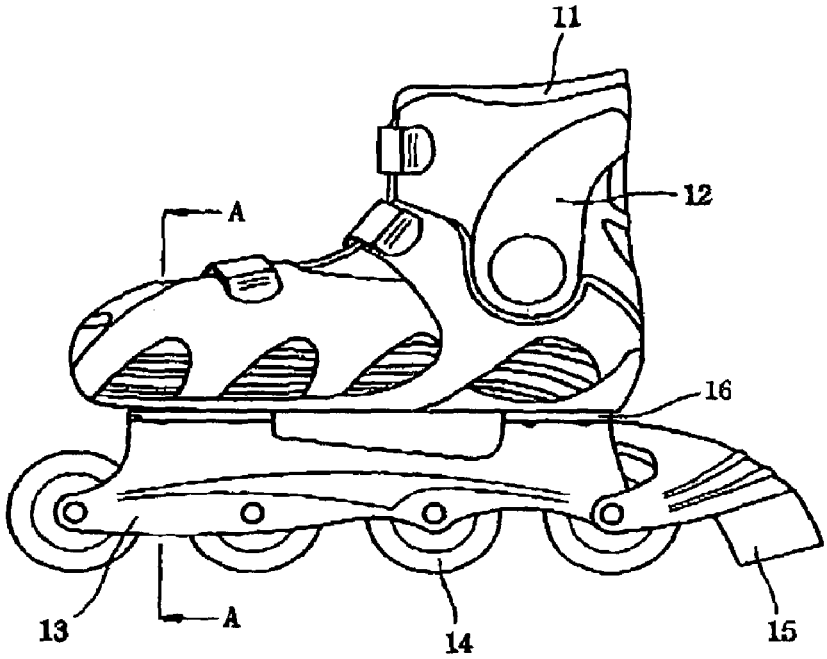
FIG.1 PRIOR ART
FIG. 1 is a side view of a conventional inline skate.
Figure 2:
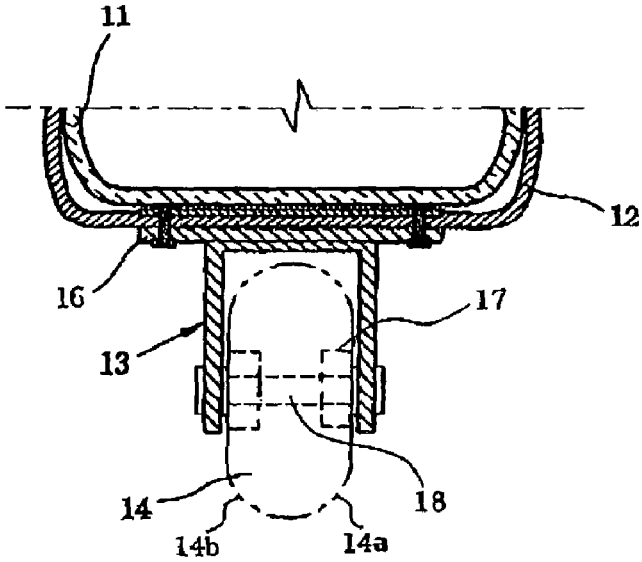
FIG.2 PRIOR ART
FIG. 2 is a partially sectional view taken on line A—A of FIG. 1.
Figure 3:
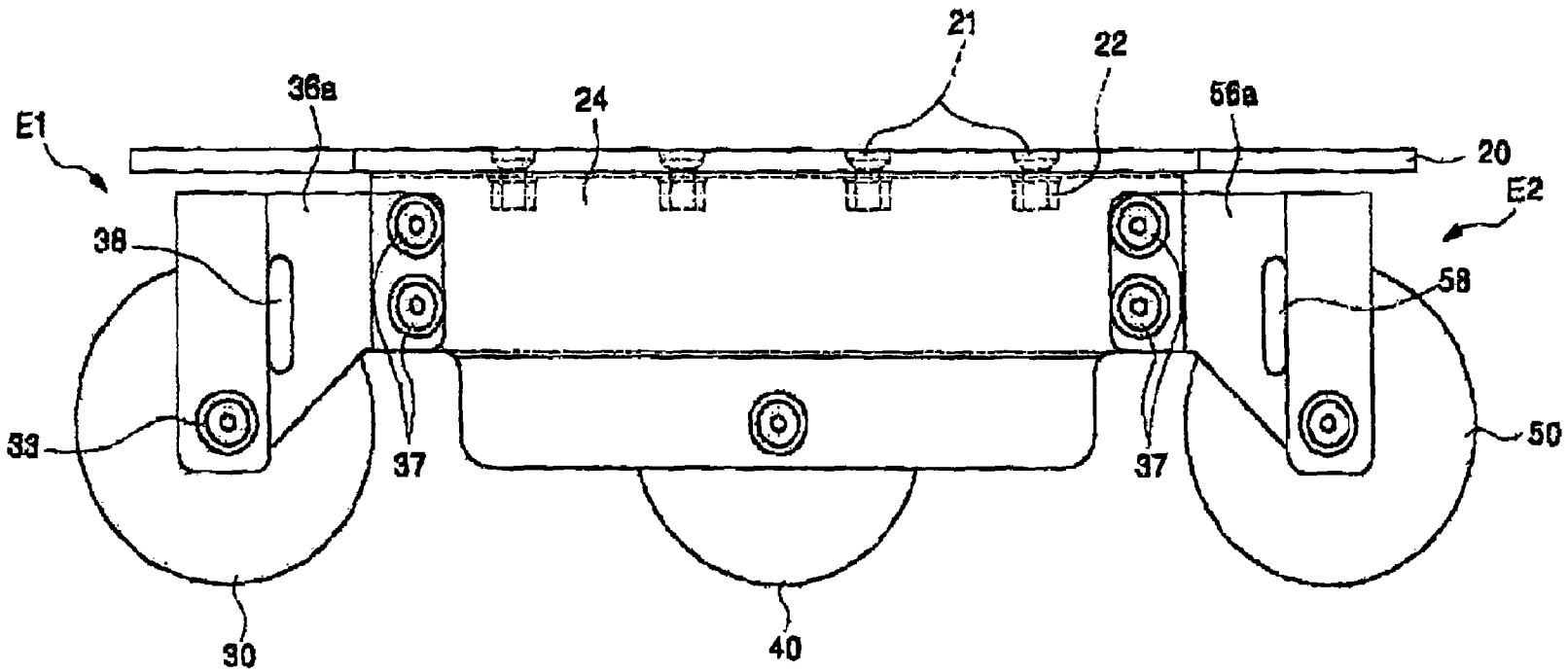
FIG. 3 is a side view of a wheel mounting portion of an inline skate according to a first embodiment of the present invention.
Figure 4:
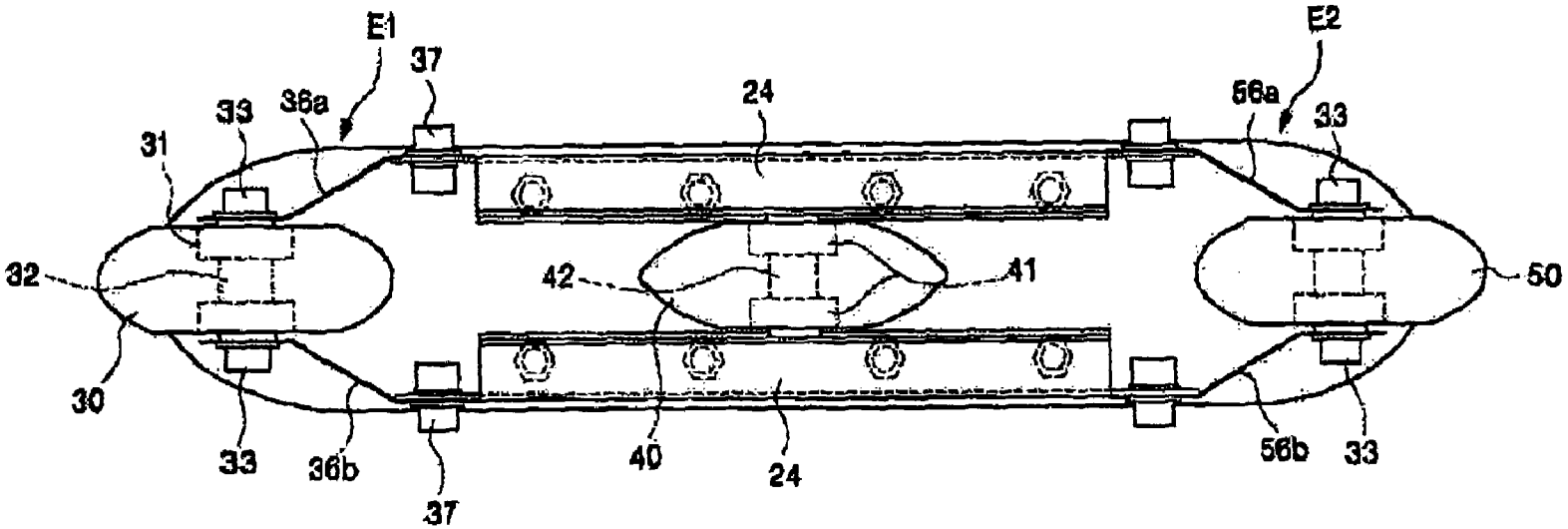
FIGS. 4 and 5 are a bottom view and a front view of FIG. 3.
Figure 5:
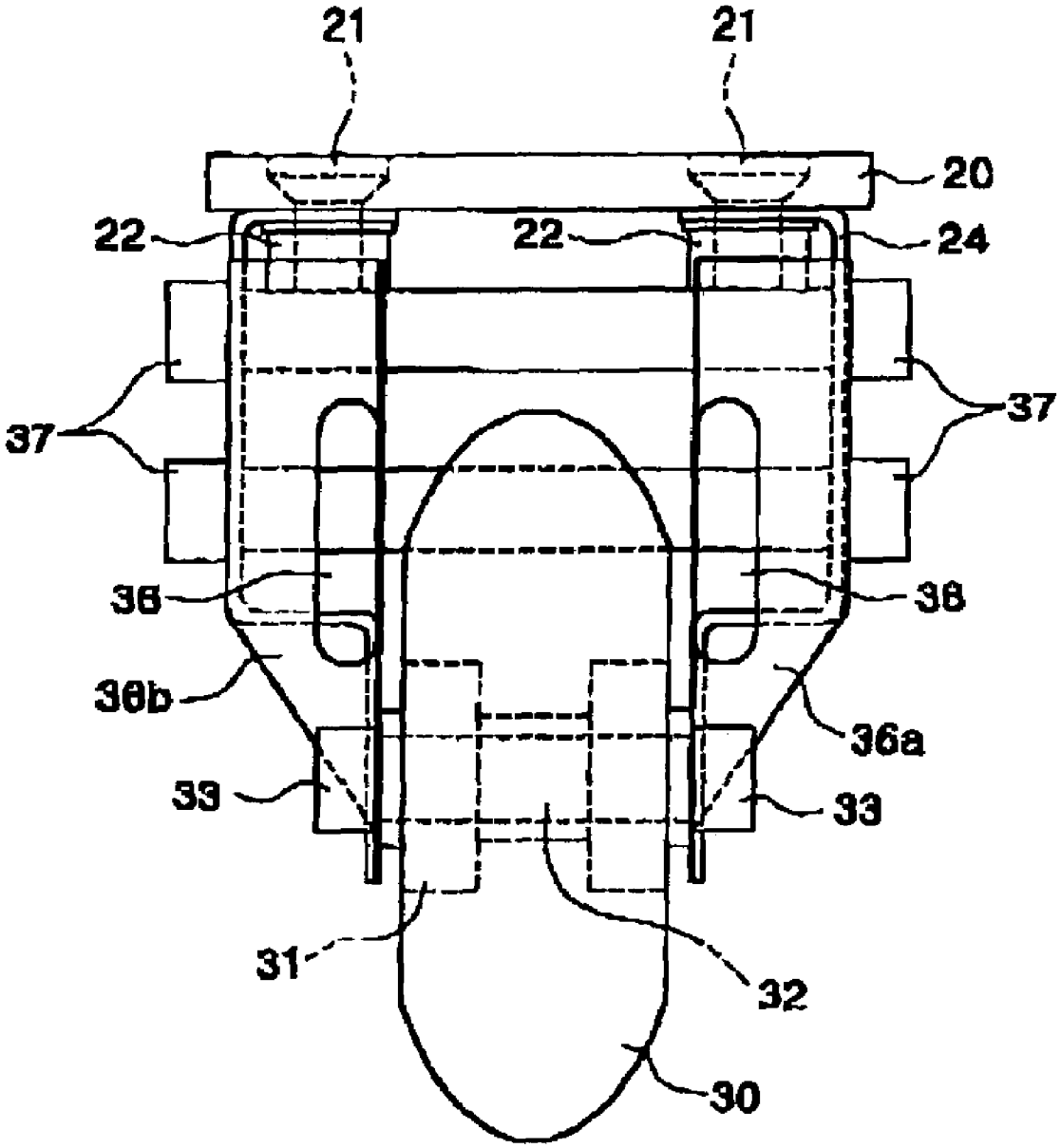
Figure 6:
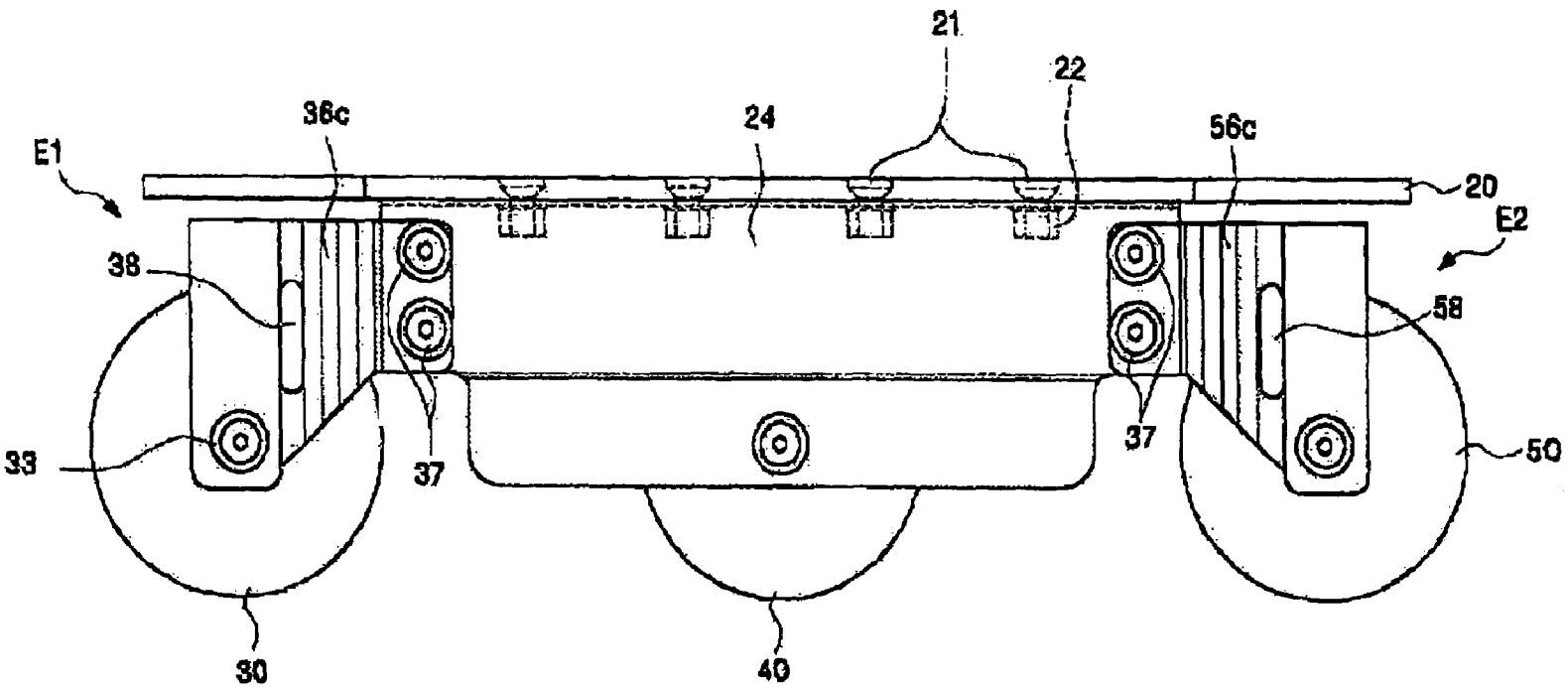
FIG. 6 is a side view of a wheel mounting portion of an inline skate according to a second embodiment of the present invention.
Figure 7:
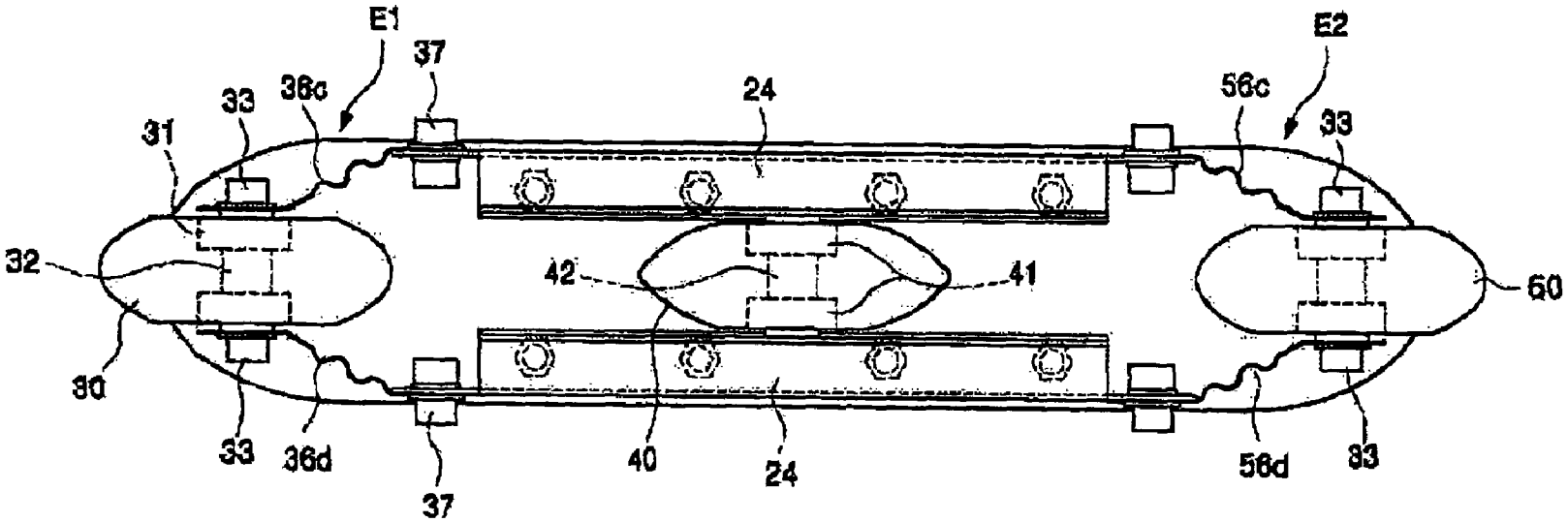
FIG. 7 is a bottom view of FIG. 6.
Figure 8:
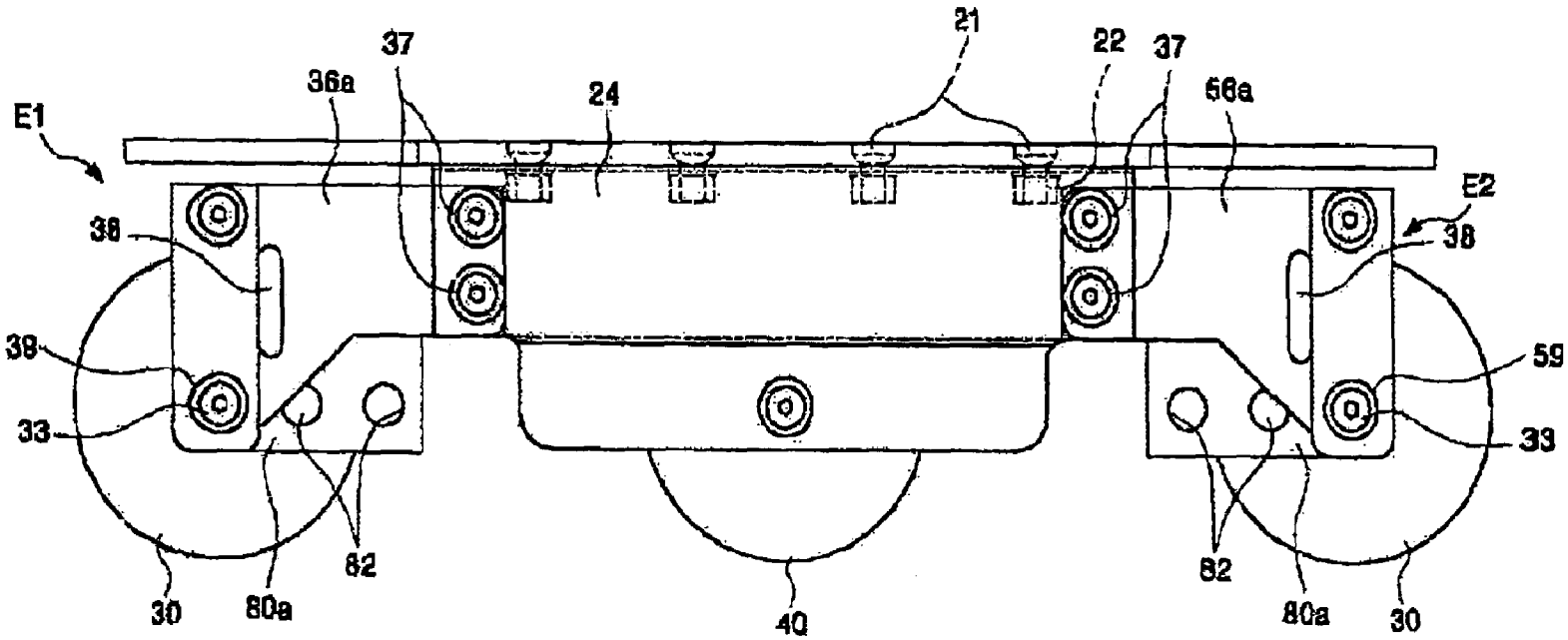
FIG. 8 is a side view of a wheel mounting portion of an inline skate according to a third embodiment of the present invention.
Figure 9:
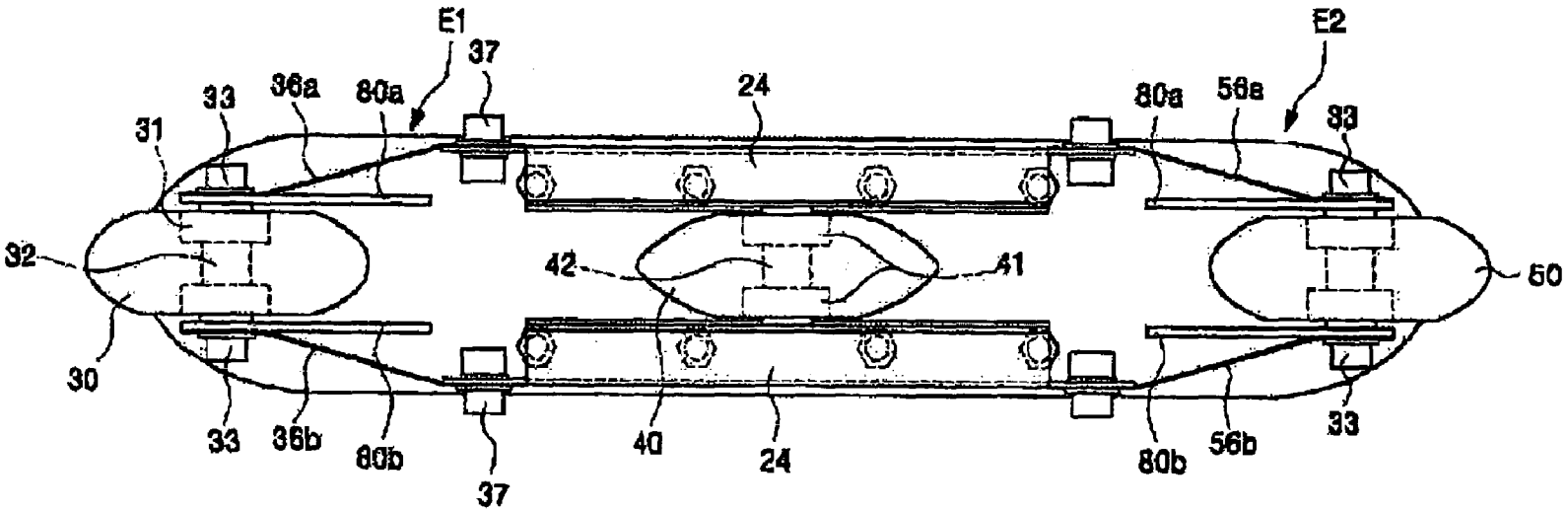
FIG. 9 is a bottom view of FIG. 8.
Figure 10:
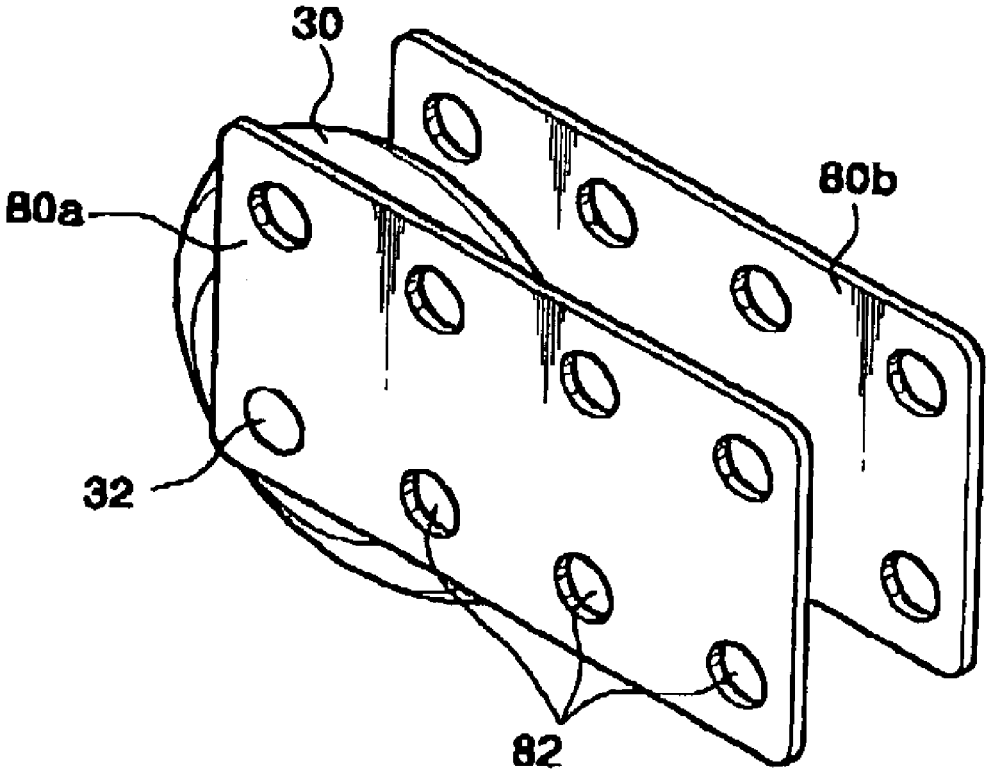
FIG. 10 is a perspective view showing a wheel fixing plate in FIG. 8.
Figure 11:
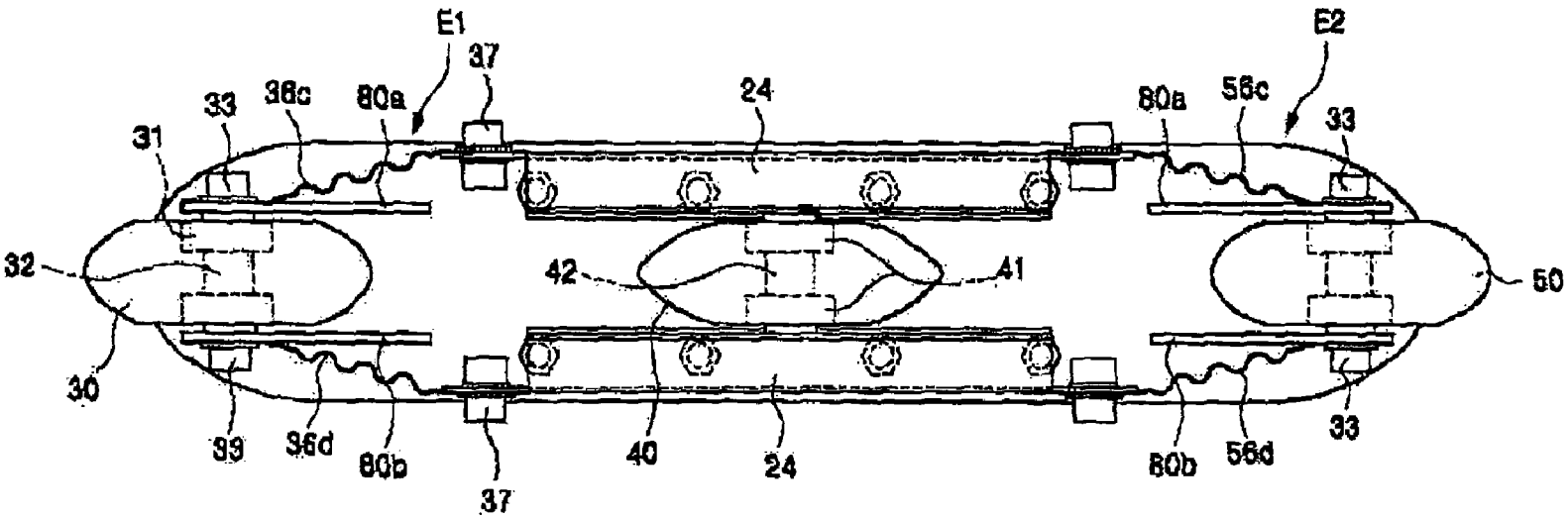
FIG. 11 is a bottom view of a wheel mounting portion of an inline skate according to a fourth embodiment of the present invention.
Figure 12:
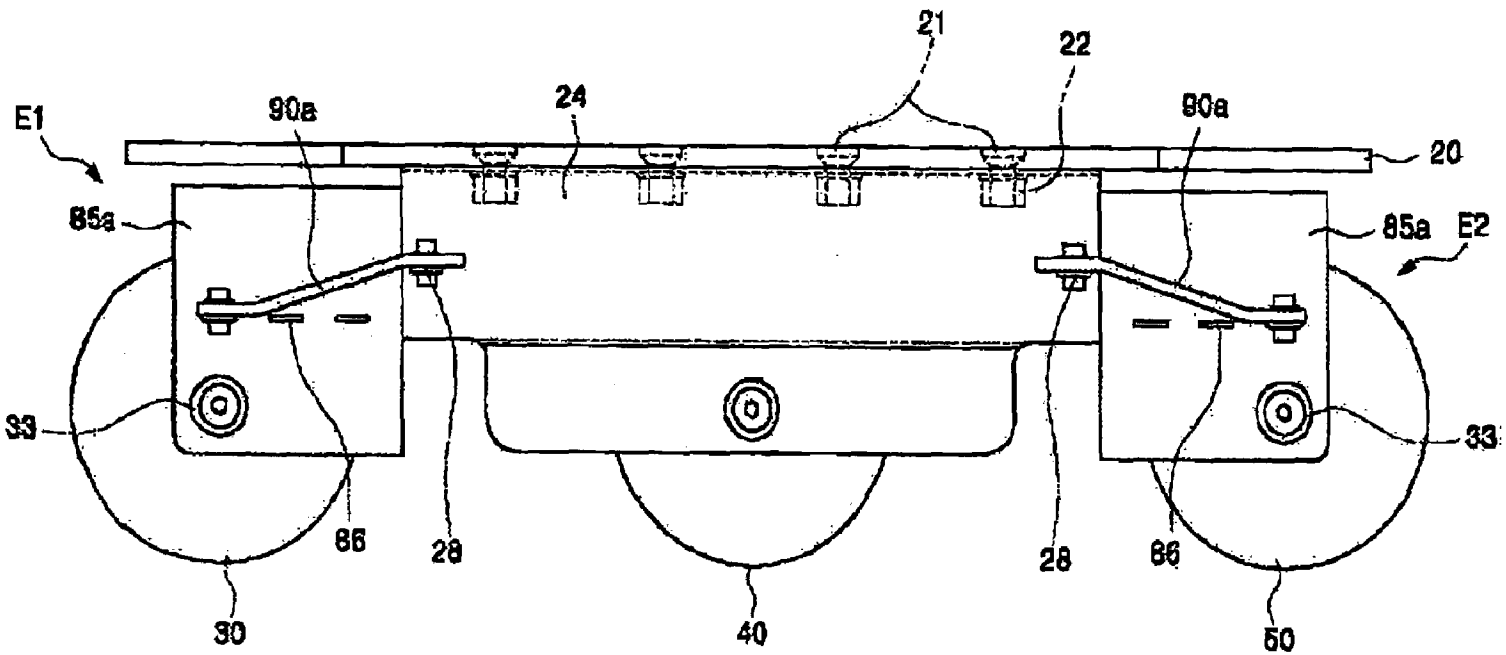
FIG. 12 is a side view of a wheel mounting portion of an inline skate according to a fifth embodiment of the present invention.
Figure 13:
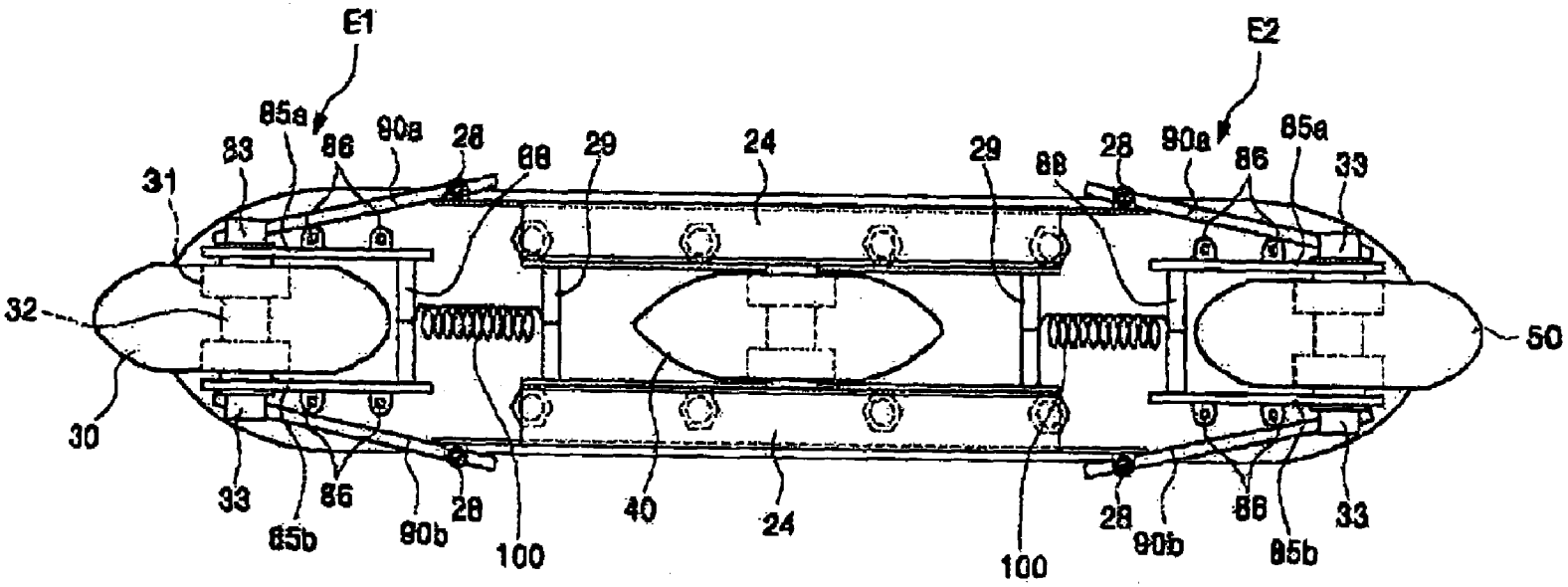
FIG. 13 is a bottom view of FIG. 12.

FIG. 3 is a side view of a wheel mounting portion of an inline skate according to a first embodiment of the present invention. FIGS. 4 and 5 are a bottom view and a front view of FIG. 3. FIG. 6 is a side view of a wheel mounting portion of an inline skate according to a second embodiment of the present invention. FIG. 7 is a bottom view of FIG. 6. FIG. 8 is a side view of a wheel mounting portion of an inline skate according to a third embodiment of the present invention. FIG. 9 is a bottom view of FIG. 8. FIG. 10 is a perspective view showing a wheel fixing plate in FIG. 8. FIG. 11 is a bottom view of a wheel mounting portion of an inline skate according to a fourth embodiment of the present invention. FIG. 12 is a side view of a wheel mounting portion of an inline skate according to a fifth embodiment of the present invention. FIG. 13 is a bottom view of FIG. 12.

Firstly, as shown in FIGS. 3 to 5, in the wheel mounting portion of the inline skate according to the first embodiment of the present invention, a wheel frame 24 is fixed by a fixing member 22 to the center of the bottom of the coupling plate 20 with a plurality of fixing recesses 21, and a middle wheel 40 is rotatably mounted to the wheel frame 24 by a axle shaft 42 and a bearing 41.

A front wheel 30 and a rear wheel 50 are symmetrically mounted at the front and rear ends of the wheel frame 24 by means of first elastic supporting means El and second elastic supporting means E2.

In the construction of the first elastic supporting means E1, a pair of leaf springs 36*a* and 36*b* are forward-extended mounted to the lateral surface of the front end of the wheel frame 24 so that the interval between the two facing leaf springs 36*a* and 36*b* becomes gradually smaller with one end secured by an engaging member 37. At the front end of the leaf springs 36*a* and 36*b*, a axle shaft 32 is mounted across the gap between the leaf springs 36*a* and 36*b* facing each other by means of a coupling member 33. The front wheel 30 is rotatably mounted to the axle shaft 32 by the bearing 31.

Additionally, the rear wheel 50 is rotatably mounted to the rear end of the wheel frame 24 by being supported by means of a pair of leaf springs 56a and 56b of the second elastic supporting means E2. At one side of the leaf springs 36*a*, 36*b*, 56*a* and 56*b*, an open cut groove 38 and 58 is formed to better flexibility of the leaf springs 36*a*, 36*b*, 56*a* and 56*b*.

FIGS. 6 and 7 shows a flexible structure in which the leaf springs can hold up better against a deformation. As shown therein, leaf springs 36*c*, 36*d*, 56*c* and 56*d* made of a platy material are formed in the shape of a pleat sheet with its outer surface forming a continuous flexure.

In another embodiment of the present invention, the front wheel 30 and the rear wheel 50 each are rotatably mounted by a length adjusting means on the elastic supporting means E1 and E2 configured so as to utilize the characteristics of a 4-bar linkage.

According to the third embodiment of the present invention, as shown in FIGS. 8 to 10, the inline skate further comprises a pair of wheel fixing plates 80*a* and 80*b* for adjusting the position where the front wheel 30 and the rear wheel 50 are put in place by adjusting the position of the axle shaft 32 in forward and backward directions on the front end of one pair of leaf springs 36*a*, 36*b*, 56*a* and 56*b* facing each other.

The wheel fixing plates 80*a* and 80*b* are formed in a flat plate shape and have a structure where the axle shaft 32 is fixed across the gap between the pair of wheel fixing plates 80*a* and 80*b* facing each other and the front wheel 30 or the rear wheel 50 is rotatably mounted on the axle shaft 32. On the outer surface of the wheel fixing plates 80*a* and 80*b*, a plurality of coupling holes 82 are horizontally formed at a predetermined interval and are fixed and coupled by selectively using fixing holes 39 and 59 of the leaf springs 36*a*, 36*b*, 56*a* and 56*b* and a separate coupling member 33.

In this embodiment, as shown in FIG. 11, the leaf springs can also have a flexible structure where they are formed in the shape of a pleat sheet with its outer surface forming a continuous flexure and thus they can stand up better against a deformation in the sufrace.

Additionally, each of the leaf springs disclosed in each of the above embodiments may have a structure where many sheets of thin leaf springs are stacked one over another so as to stand up better against a deformation in the surface.

In still another embodiment of the present invention, as shown in FIGS. 12 and 13, the front wheel 30 and the rear wheel 50 each are rotatably mounted on a wheel supporting unit consisting of supporting plates 85*a* and 85*b*, a axle shaft 32 and a supporting shaft 88. The wheel supporting unit is supported by being coupled to a pair of link bars 90*a* and 90*b* on a hinge with one end coupled to the lateral surface of the front or rear end of the wheel frame 24, and is provided with a tension spring 100 for holding the wheel supporting unit.

The supporting plates 85*a* and 85*b* are formed in a flat plate shape and the axle shaft 32 is fixed across the gap between the pair of supporting plates 85*a* and 85*b* by a coupling member 33 On the axle shaft 32, the front wheel 30 and the rear wheel 50 each are rotatably mounted. On the outer surface of the supporting plates 85*a* and 85*b*, a plurality of hinge coupling protrusions 86 are horizontally formed at a predetermined interval.

Additionally, the supporting shaft 88 is mounted parallel at a predetermined interval from the axle shaft 32 across the gap between the pair of the facing supporting plates 85*a* and 85*b*.

And, a pair of link bars 90*a* and 90*b* are mounted, with one end coupled to a hinge coupling protrusion 28 formed on one outer surface of the front and rear ends of the wheel frame 24 and with the interval between the two facing link bars 90*a* and 90*b* becoming smaller as they extend toward the front and rear ends of the wheel frame 24. The other end of each link bar 90*a* and 90*b* is selectively coupled to a plurality of hinge coupling protrusions 86 formed on the outer surface of the supporting plates 85*a* and 85*b*.

At this time, each hinge coupling is achieved in such a manner that the link bars 90*a* and 90*b* each can perform a bilateral rotary motion with respect to the wheel frame 24 and the supporting plates 85*a* and 85*b*.

In addition, on the front and rear ends of the wheel frame 24, a fixing shaft 29 is connectively mounted between the wheel frames 24 under the coupling plate 20. Between the fixing shaft 29 and the supporting axis 88 connected across the gap between the supporting plates 85*a* and 85*b*, the tension spring 100 is connected.

As seen from above, in the inline skate, the front wheel 30 and the rear wheel 50 each are mounted on the front and rear of the wheel frame 24 so that they are bilaterally steerable by means of the first elastic supporting means E1 and the second elastic supporting means E2. Between the front wheel 30 and the rear wheel 50, one or more middle wheels 40 are mounted on the wheel frame 24

At this time, if the user moves their center of gravity outward or inward to hold an edge, the first elastic supporting means E1 and the second elastic supporting means E2 show the behavior characteristics of a 4-bar linkage during operation, thereby steering the front wheel 30 and the rear wheel 50 by a predetermined angle. That is, the front wheel 30 and the rear wheel 50 can be steered more smoothly within a predetermined angle by allowing the front wheel 30 and the rear wheel 50 to be pressed in an axial direction when moving one's center of gravity for changing a direction.

Hereinafter, a pressing means for pressing the front wheel 30 and the rear wheel 50 when changing direction will now be described.

Figure 14:
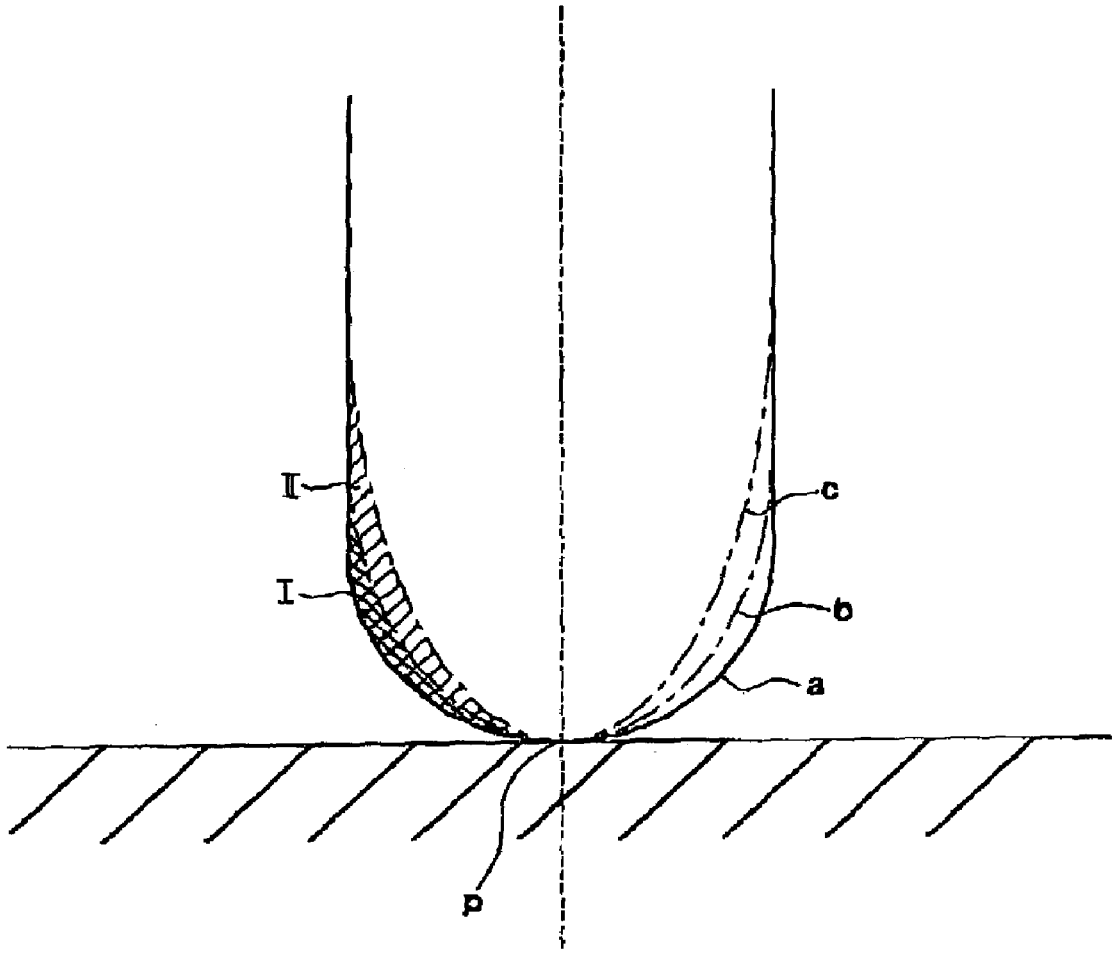
FIG. 14 is an enlarged sectional view of the principal part showing the shape of a wheel for explaining pressing means according to the first embodiment of the present invention.
Figure 15:
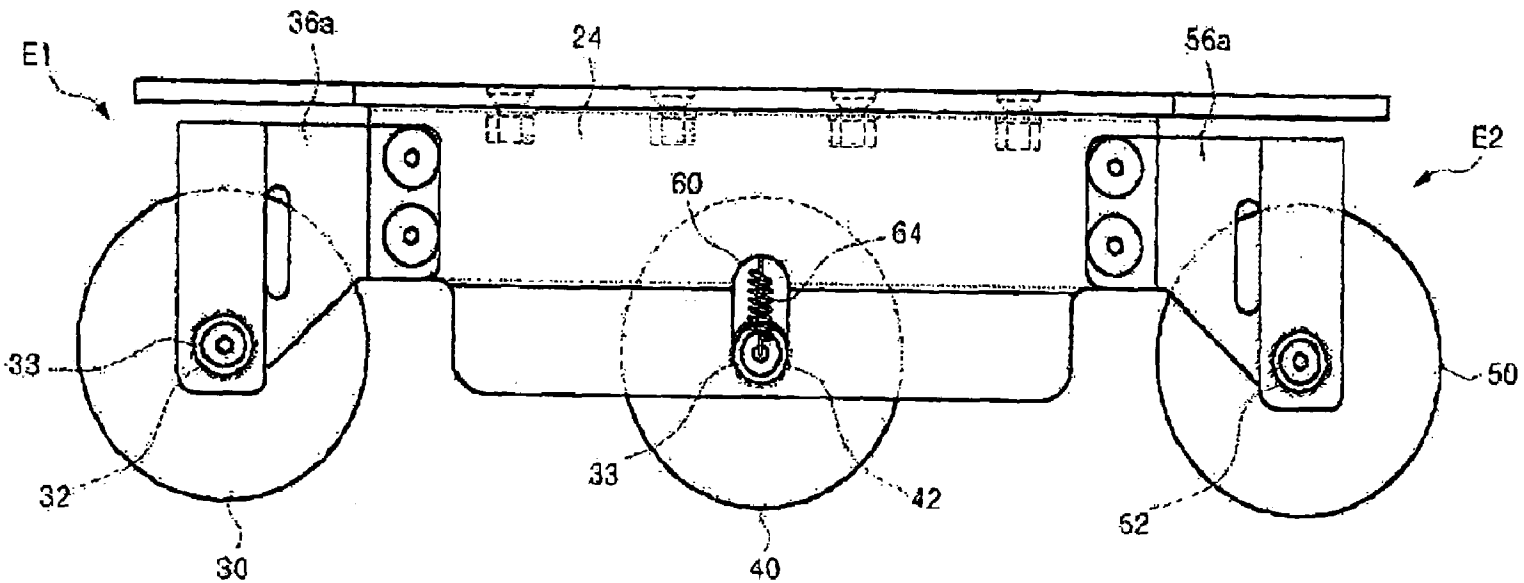
FIG. 15 is a side view of the wheel mounting portion of the inline skate for explaining pressing means according to the second embodiment of the present invention.
Figure 16:
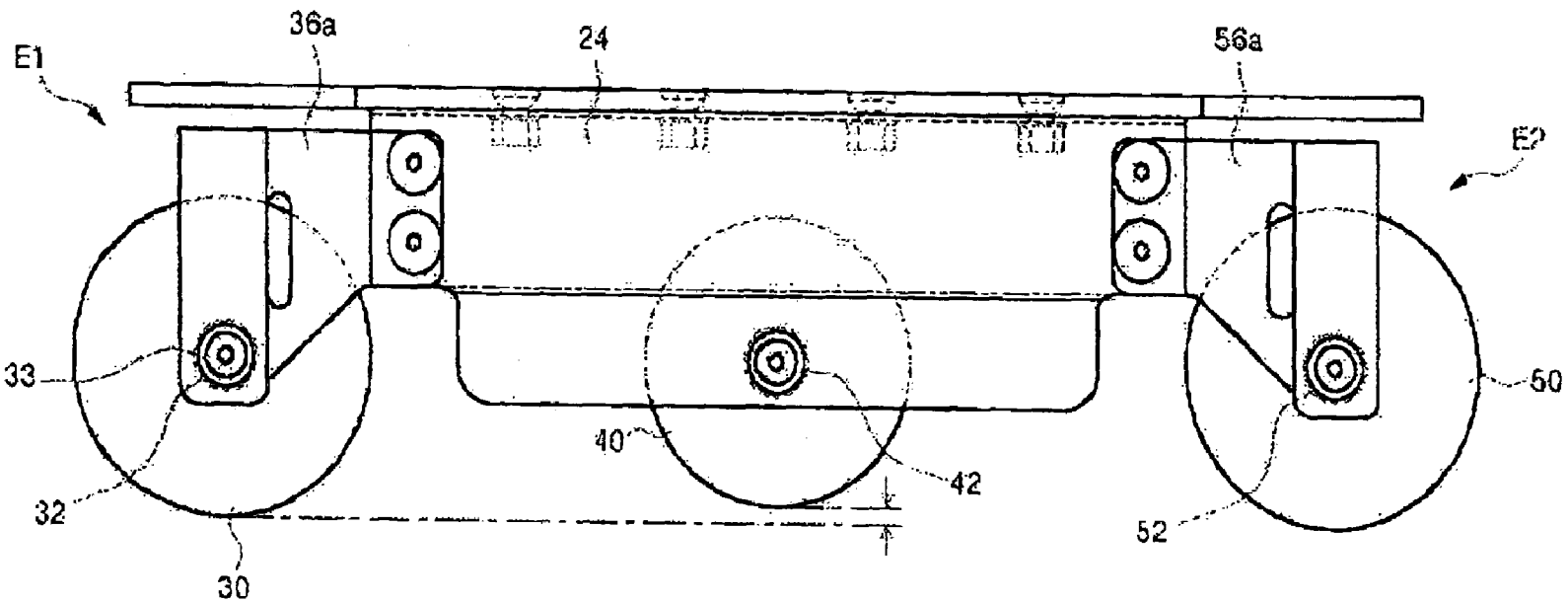
FIG. 16 is a side view of the wheel mounting portion of the inline skate for explaining pressing means according to the third embodiment of the present invention.
Figure 17:
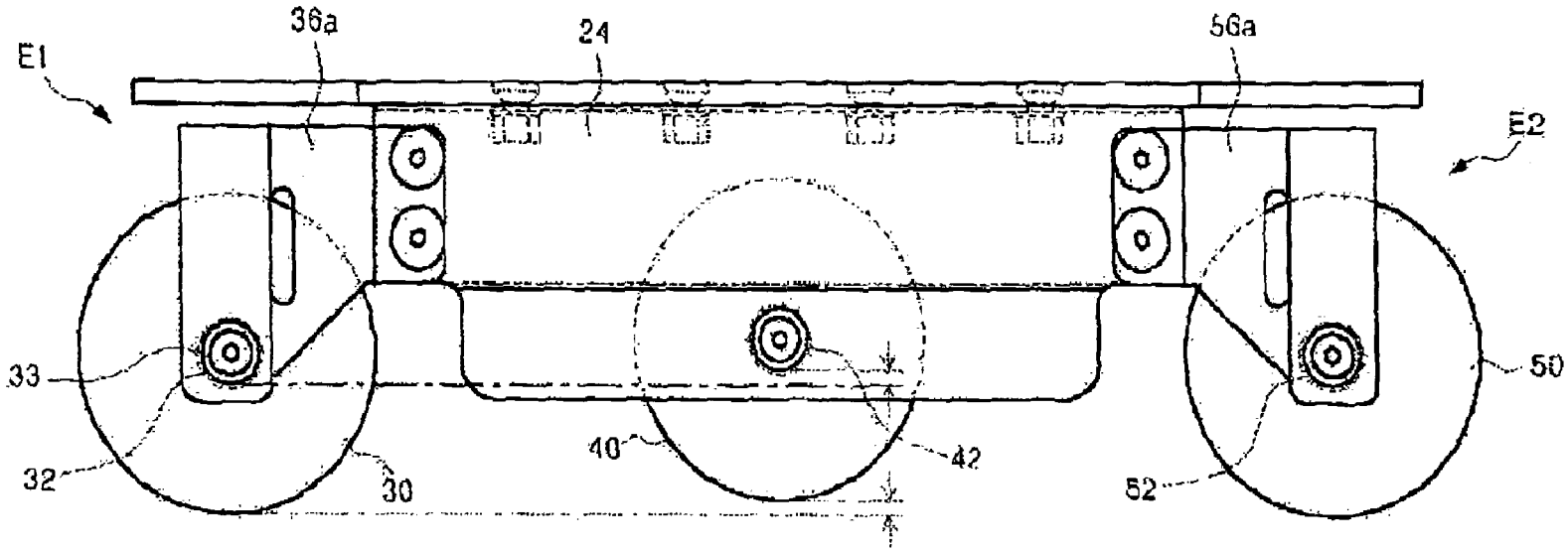
FIG. 17 is a side view of the wheel mounting portion of the inline skate for explaining pressing means according to the fourth embodiment of the present invention.
Figure 18:
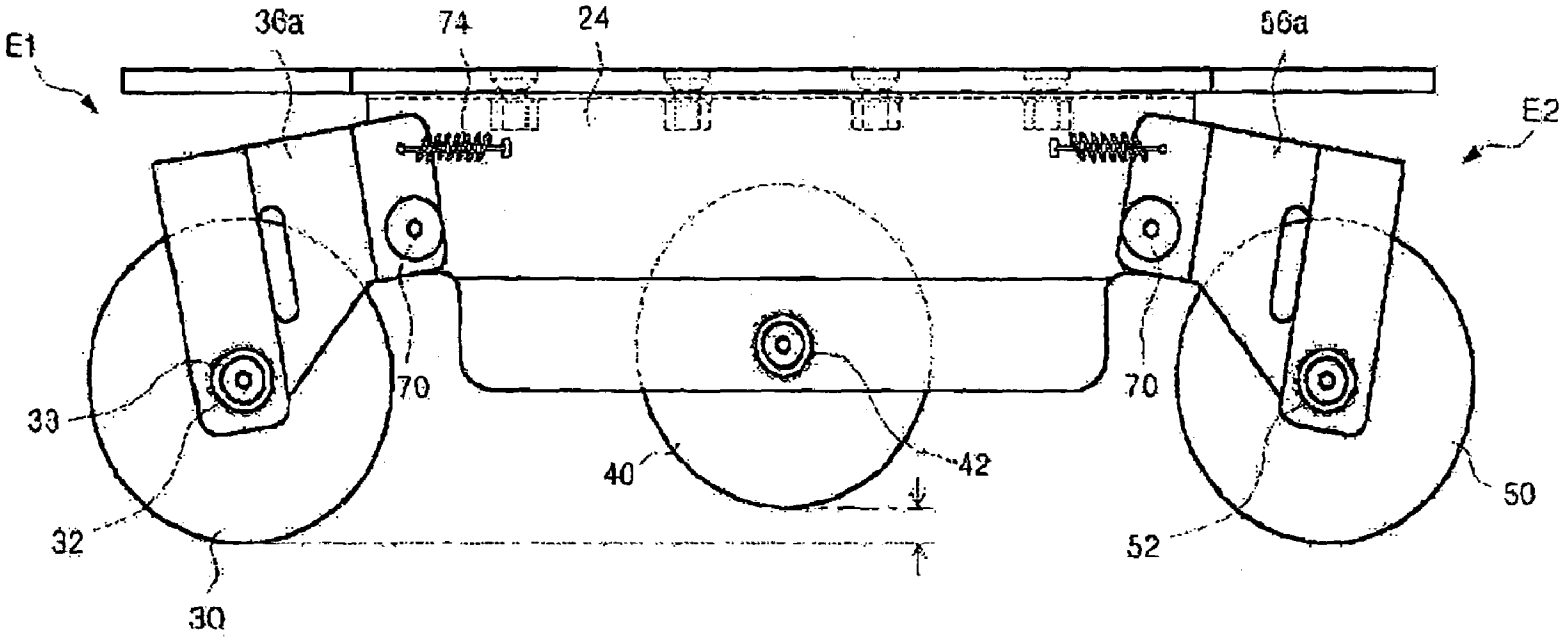
FIG. 18 is a side view of the wheel mounting portion of the inline skate for explaining pressing means according to the fifth embodiment of the present invention.
Figure 19:
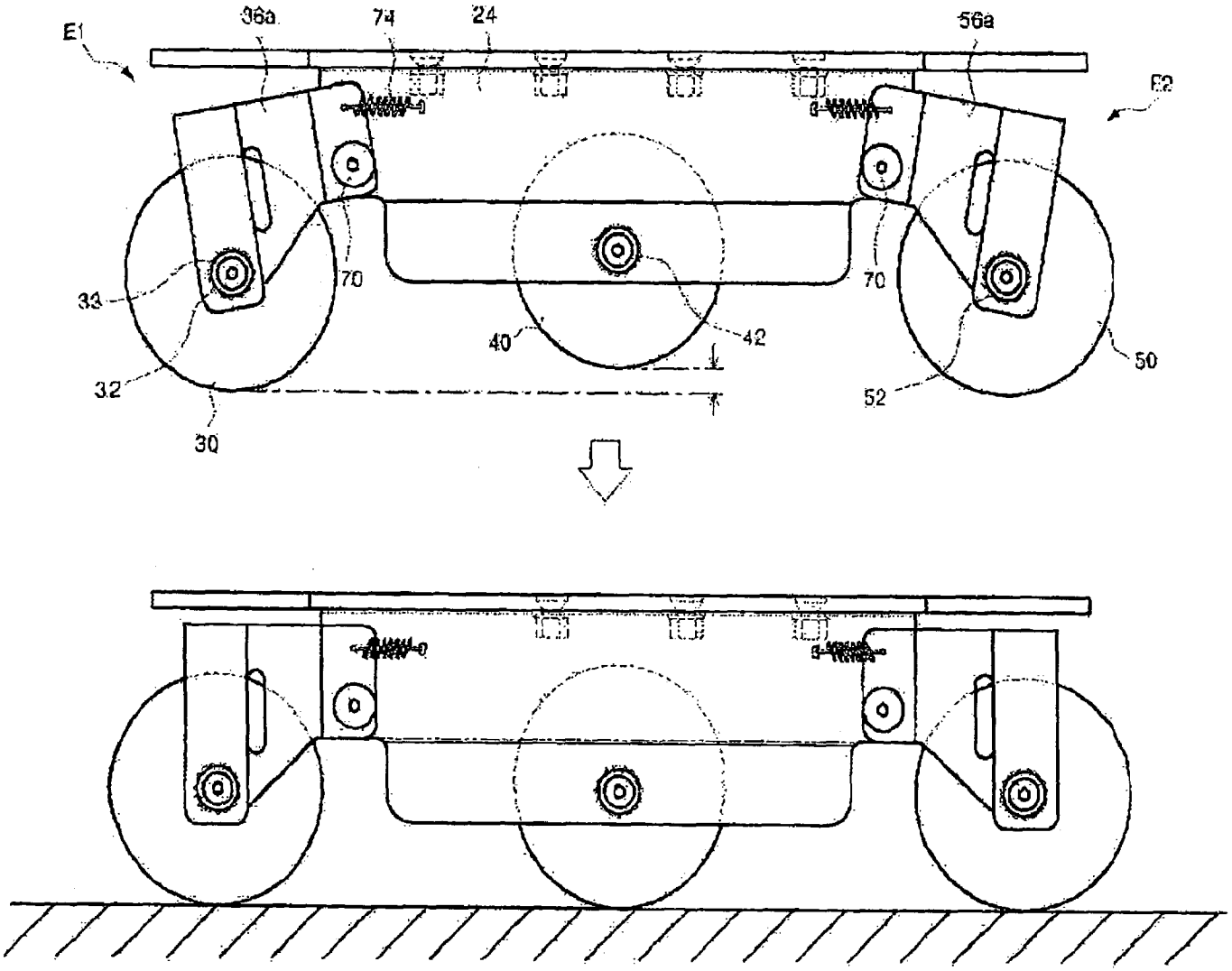
FIG. 19 is a schematic view for explaining the working principle of the inline skate having the pressing means according to the fifth embodiment of the present invention.

FIG. 14 is an enlarged sectional view of the principal part showing the shape of a wheel for explaining the pressing means according to the first embodiment of the present invention. FIG. 15 is a side view of the wheel mounting portion of the inline skate for explaining the pressing means according to the second embodiment of the present invention. FIG. 16 is a side view of the wheel mounting portion of the inline skate for explaining the pressing means according to the third embodiment of the present invention. FIG. 17 is a side view of the wheel-mounting portion of the inline skate for explaining pressing means according to the fourth embodiment of the present invention. FIG. 18 is a side view of the wheel mounting portion of the inline skate for explaining pressing means according to the fifth embodiment of the present invention. FIG. 19 is a schematic view for explaining the working principle of the inline skate having the pressing means according to the fifth embodiment of the present invention.

The pressing means according to the first embodiment of the present invention will now be described. As shown in FIG. 14, the middle wheel 40 located between the front wheel 30 and the rear wheel 50 is configured in such a manner that their outer and inner curved surfaces have a sharper curve from a contact point P rolling-contacted with the ground than the outer and inner curved surfaces of the front wheel 30 and rear wheel 50.

That is, the sectional shape of the middle wheel 40 has a smaller curvature than the front wheel 30 and the rear wheel 50. The farther the curved surface extends upward from the ground contact point P, the larger the gap (region I) between the curved surface a of the front and rear wheels 30 and 50 and the curved surface b of the middle wheel 40 becomes At this time, if the curvature of the sectional shape of the middle wheel 40 becomes smaller than the above one, the curved surface c has a shaper curve. Thus, the farther the curved surface extends upward from the contact point P, the larger the gap (II) the curved surface a of the front and rear wheels 30 and 50 and the curved surface b of the middle wheel 40 becomes than the above one.

The middle wheel 40 is fixed and supported on the wheel frame 24 so that it can have the same diameter as the front and rear wheels 30 and 50 and its axle shaft 42 can be located on the same horizon as the axle shafts 32 and 52 of the front and rear wheels 30 and 50.

In this way, the sectional shape of the middle wheel 40 mounted on the wheel frame 24 is formed to have a shaper curve than the sectional shape of the front and rear wheels 30 and 50, thereby creating different shapes between the wheels. As such, in the case where the user moves their center of gravity outward or inward to hold an edge, as the outer or inner curved surface of the middle wheel 40 is separated from the ground, the weight of the user is put much more on the front and rear wheels 30 and 50 and pressed down to smoothly steer the front and rear wheels 30 and 50.

In the pressing means according to the second embodiment of the invention, as shown in FIG. 15, the axle shaft 42 of the middle wheel 40 is located on the same horizon as the axle shafts 32 and 52 of the front and rear wheels 30 and 50 and is made vertically movable within a predetermined range.

The middle wheel 40 has a sectional shape of the same diameter and same curvature as the front and rear wheels 30 and 50 and is located between the front wheel 30 and rear wheel 50 to be supported on the wheel frame 24. That is to say, the axle shaft 42 of the middle wheel 40 is supported on the wheel frame 24 by means of a coupling member 33 such as a bolt.

And, on the wheel frame 24 where the axle shaft 42 of the middle wheel 40 is supported, a long hole 60 having a predetermined length is formed and a first elastic member 64 is provided for providing elasticity to the axle shaft 42 supported by the long hole 60.

The first elastic member 64 is provided above the axle shaft 42 of the middle wheel 40 within the long hole and as a result the middle wheel 40 is made elastically and vertically movable.

Therefore, when the user performs a motion which makes the outer or inner surface of the wheel contact the ground by moving their center of gravity for changing direction of the inline skate, that is, a so-called edge holding motion, the front wheel 30 and the rear wheel 50 are kept fixed by the elastic supporting means E1 and E2 while the middle wheel 40 moves upward as it applies a predetermined compression force to the first elastic member 64.

Hence, upon changing direction, as the front wheel 30 and the rear wheel 50 are pressed due to a deformation of the first elastic member 64 mounted on the middle wheel 40, the front wheel 30 and the rear wheel 50 are steered by the behavior of the elastic supporting means E1 and E2.

In the pressing means according to the third embodiment of the invention, as shown in FIG. 16, the middle wheel 40 has a sectional shape of the same curvature as the front and rear wheels 30 and 50, and it has a smaller diameter than the front and rear wheels 30 and 50.

The middle wheel 40 is fixed and supported on the wheel frame 24 so that it can be located on the same horizon as the axle shafts 32 and 52 of the front and rear wheels 30 and 50. As a result, the middle wheel 40 does not contact the ground but is spaced above it at a predetermined gap, with the front wheel 30 and the rear wheel 50 contact to the ground and vertically raised.

In the pressing means according to the fourth embodiment of the invention, as shown in FIG. 17, the middle wheel 40 has a sectional shape of the same diameter and same curvature as the front and rear wheels 30 and 50, and it is fixed and supported to the wheel frame 24 so that its axle shaft 42 can be located higher than the axle shafts 32 and 52 of the front and rear wheels 30 and 50.

Therefore, in the same manner as in the third embodiment, the middle wheel 40 is not contacted on the ground but is spaced above it at a predetermined gap, with the front wheel 30 and the rear wheel 50 contacting the ground and vertically raised, According to the third and fourth embodiments of the invention, the middle wheel 40 does not contact the ground but is spaced above it at a predetermined gap, with the front wheel 30 and the rear wheel 50 being contacted to the ground and vertically raised. When an edge is held for changing direction of the inline skate, the front and rear wheels 30 and 50 are pressed in an axial direction to thus be steered According to the fifth embodiment of the invention, as shown in FIG. 18, the pressing means includes a hinge portion 70 provided on the rear end of the pair of leaf springs 36*a*, 36*b*, 56*a* and 56*b* mounted with the front wheel 30 and the rear wheel 50 and allowing each of the leaf springs 36*a*, 36*b*, 56*a* and 56*b* to be vertically rotated relative to the wheel frame 24, a second elastic member 74 for providing elasticity to each of the leaf springs 36*a*, 36*b*, 56*a* and 56*b* rotating around the hinge portion 70 and a middle wheel 40 having the a sectional shape of the same diameter and same curvature as the front and rear wheels 30 and 50.

The hinge portion 70 is provided at the lower end of the rear end portion of each of the leaf springs 36*a*, 36*b*, 56*a* and 56*b* so that the leaf springs 36*a*, 36*b*, 56*a* and 56*b* each can be vertically and rotatably coupled to the front and rear end of the wheel frame 24.

With one end being horizontally fixed to the upper end of the rear end portion of the leaf springs 36*a*, 36*b*, 56*a* and 56*b* and the other end being fixed to the wheel frame 24, the second elastic member 74, it provides an elastic force to the leaf springs 36*a*, 36*b*, 56*a* and 56*b* so that the leaf springs 36*a*, 36*b*, 56*a* and 56*b* can vertically rotated around the hinge portion 70.

At this time, in order that the leaf springs 36*a*, 36*b*, 56*a* and 56*b* are kept rotated downward around the hinge portion 70 within a predetermined angle with no external load being applied, the size and fixing position of the second elastic member 74 are determined.

The middle wheel 40 is fixed and supported on the wheel frame 24 so that its axle shaft 42 can be located on the same horizon as the axle shafts 32 and 52 of the front and rear wheels 30 and 50 under the condition that the leaf springs 36*a*, 36*b*, 56*a* and 56*b* are not rotated around the hinge portion and are kept parallel.

Hence, where no external load is applied as the leaf springs 36*a*, 36*b*, 56*a* and 56*b* fixing the front and rear wheels 30 and 50 are rotate within a predetermined angle around the hinge portion 70 with respect to the wheel frame 24, the front wheel 30 and the rear wheel 50 are kept lower than the middle wheel 40.

However, as shown in FIG. 19, when the inline skate is vertically raised off the ground with the weight of the user being applied, the leaf springs 36*a*, 36*b*, 56*a* and 56*b* are rotated upward around the hinge portion 70 while compressing the second elastic member 74 and are thus kept parallel. Resultantly, the axle shafts 32, 42 and 52 of the front, rear and middle wheels are located on the same horizon.

In this state, when an edge is held for changing direction of the inline skate, the leaf springs 36*a*, 36*b*, 56*a* and 56*b* are pushed forward by the elastic force of the second elastic member 74 maintaining a compressed state. As a result, the force is applied in such a manner that the leaf springs 36*a*, 36*b*, 56*a* and 56*b* can be rotated downward around the hinge portion 70, thus the front and rear wheels 30 and 50 are pressed and steered.

Hereinafter, the operation and effects of the inline skate thus configured according to the embodiments of the invention will be described in detail.

Figure 20:
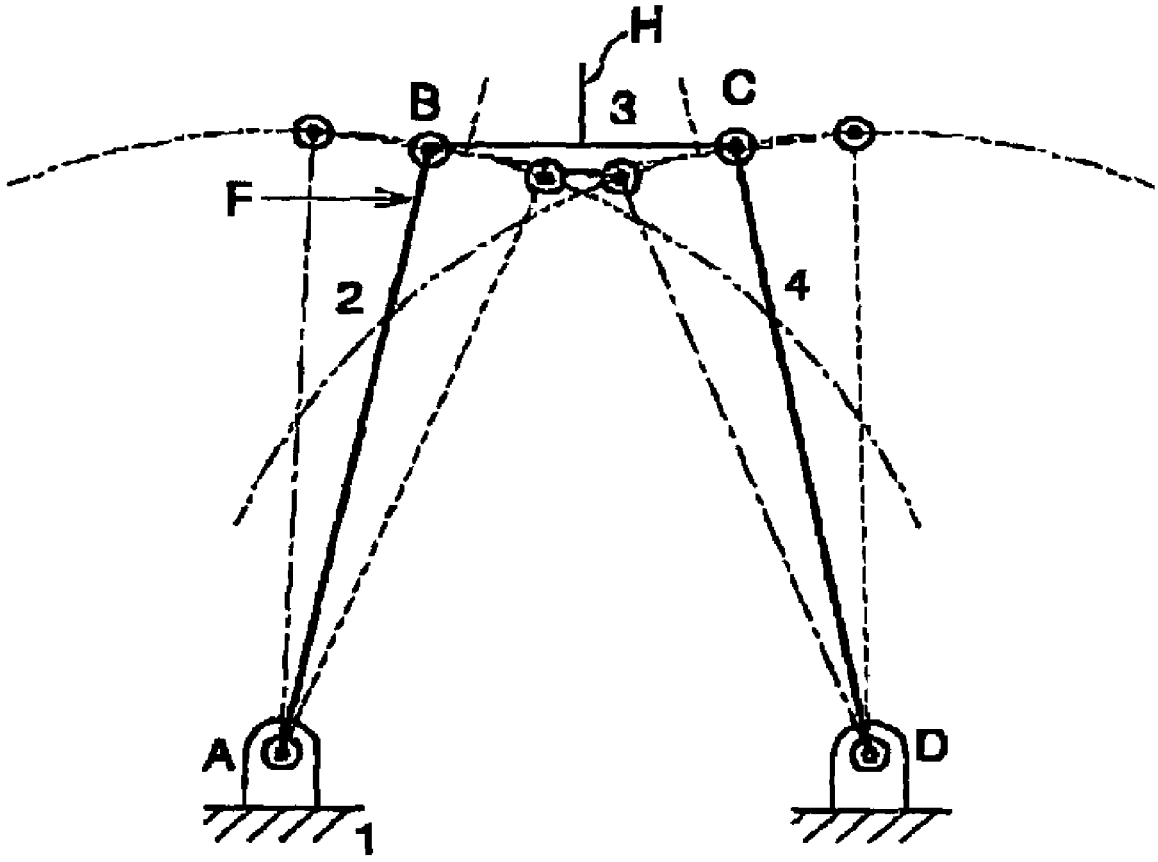
FIG. 20 is an illustrative view showing a trapezoidal linkage apparatus for explaining the operation of the present invention.

Firstly, to help with the understanding of the operating principle of the invention, the behavior of a trapezoidal linkage will be explained. As shown in FIG. 20, in a linkage apparatus having four links hingeably coupled thereto for enabling rotary motion, since the length of link 2 and link 4 are the same and the length of link 3 is smaller than the center distance AD, the linkage apparatus is form in a trapezoidal shape.

In the apparatus thus configured, when an external force F is applied from outward in a direction parallel with the link 3, the link 2 and the link 4 are made movable on a circular orbit having a radius of the link length. By this operation, the link 3 connected between the link 2 and the link 4 is inclined in the direction in which each link moves.

Therefore, the index line H vertically connected onto the link 3 performs a rotary motion in the direction opposite to the direction of the applied external force.

The present invention is of a structure in which the front and rear wheels 30 and 50 of the inline skate can be steered using the first and second elastic means showing the behavior characteristics of the trapezoidal linkage. The leaf springs 36*a*, 36*b*, 56*a* and 56*b* shown in this embodiment serve as the link 2 and the link 4. The front and rear wheels 30 and 50, which are rotatably mounted by the axle shaft 32 between the leaf springs facing each other on the front end of the leaf springs 36*a*, 36*b*, 56*a* and 56*b*, carry out the same operation as the index line H vertically connected to the link 3.

Similarly, in the embodiments of the invention, the leaf springs 36*a*, 36*b*, 56*a* and 56*b* or link bars 90*a* and 90*b* are arranged in such a manner that the gap between the facing leaf springs or link bars becomes gradually smaller as they extend to the front end so as to perform the same operation as the trapezoidal linkage.

Therefore, where the user wants to change direction while moving, when the user performs the motion of making the outer or inner surface of the wheel contact the ground by moving their center of gravity changing the direction of the inline skate, that is, a so-called "edge holding motion", the front wheel 30 and the rear wheel 50 mounted on the leaf springs 36*a*, 36*b*, 56*a* and 56*b* are given a force outward or inward as they are pressed by the pressing means.

At this time, the leaf springs 36*a*, 36*b*, 56*a* and 56*b* are deformed by the outward or inward applied force within a predetermined bilateral range (within the elastic limit range of the leaf springs) in the same way as the behavior of the link 2 and the link 4. The front and rear wheels 30 and 50 mounted between the one pair of leaf springs are steered to the left or the right within the predetermined angle.

At this time, the front and rear wheels 30 and 50 each are arranged on the front and rear ends of the wheel frame 24 so as to be in the opposite direction to each other. Thus, their rotation is opposite each other with respect to the same movement of the user, thereby achieving a smooth direction change.

In this way, as the front and rear wheels 30 and 50 are steered within a predetermined angle, the user can change the direction by even a slight movement. This can be adapted efficiently for changing the direction, especially, at high speed.

In addition, where the front and rear wheels 30 and 50 are given a force by the friction with the ground, the relative motion between the wheels and the ground is decreased by the steering motion within a predetermined angle. Thus, reduction in the abrasion of the wheels is also achieved.

Further, when the user balances their center of gravity, the leaf springs supporting the front and rear wheels 30 and 50 are restored to the original state by their elastic force, whereby all the wheels are re-aligned aligned in a straight line and thus the skate can move linearly.

As shown in FIGS. 12 and 13, in the structure where the link bars 90*a* and 90*b* are used in place of the leaf springs, a tension spring 100 is further included to provide an elastic force for restoring the front and rear wheels 30 and 50 to the original position.

As shown in FIGS. 7 and 11, if the leaf spring has a corrugation structure, they are deformed to a large extent and can reduce a local stress, as compared to ones having a simple plate type structure.

In other words, the rotary angle of the wheels is enlarged to make spinning easier and, the stress applied to the leaf springs is reduced to increase the life of the leaf springs.

And, as shown in FIGS. 9 and 13, by selectively coupling the front end of the leaf springs 36*a*, 36*b*, 56*a* and 56*b* or link bars 90*a* and 90*b* to the plurality of coupling holes 82 formed on the outer surface of the wheel fixing plates 80*a* and 80*b* or to the plurality of hinge coupling protrusions 86 formed on the outer surface of the supporting plates 85*a* and 85*b*, the axle shaft 32 is located close to or far from the wheel frame 24, thereby adjusting the position of the front and rear wheels 30 and 50.

At this time, the front and rear wheels 30 and 50 are the regions on which a load is applied upon the change direction. The farther the front and rear wheels 30 and 50 become from the front end of the leaf springs or link bars, the stronger the elastic force of the elastic supporting means becomes.

Although the above embodiments show a structure having three wheels in all arranged on the lower side of the boot, including one middle wheel 40 mounted on the wheel frame 24, it is apparent that a plurality of middle wheels may be mounted on the wheel frame.

As described above, the present invention allows the front and rear wheels among the plurality of wheels arranged in a single row to be steered within a predetermined angle by utilizing the structure of a trapezoidal linkage. By this, the user can change direction more easily and can move the inline skate in a desired direction even at high speeds. Thus, the risk of accidents is reduced and the slippage between the outer or inner curved surface of the wheels and the ground is reduced for changing direction, thereby reducing wheel wear and lengthening their life.

What is claimed is:

1. An inline skate having a plurality of wheels rolling-contacted with the ground rotatably arranged on a wheel frame in a line, comprising;

a front wheel mounted on the front end of the wheel frame by first elastic supporting means extending forward and showing the behavior characteristics of a trapezoidal linkage;

a rear wheel mounted on the rear end of the wheel frame in the direction opposite to the front wheel by second elastic supporting means; and a pressing means for deforming the front and rear wheels in an axial direction in order to steer of the inline skate, wherein the first elastic supporting means and the second elastic supporting means each comprises:

a pair of leaf springs where one end is fixed to the lateral surface of the wheel frame and which are extended in such a manner that the gap between the two leaf springs facing each other becomes gradually smaller; and a axle shaft which is connected to the front end of the leaf springs across the gap between the facing leaf sprigs and on which the front and rear wheels are rotatably mounted.

2. The inline skate of claim 1, wherein the first elastic supporting means and the second elastic supporting means further comprises:

a wheel supporting unit consisting of a pair of supporting plates each having a hinge coupling protrusion formed on one outer surface, a axle shaft which is connected in parallel to the front end of the leaf springs across the gap between the facing leaf springs and on which the front and rear wheels are rotatably mounted and a supporting axis which is connectively mounted in parallel at a predetermined interval from the axle shaft across the gap between the pair of the facing supporting plates;

a pair of link bars with one end being hingeably coupled to the lateral surface of the wheel and the other end being hingeably coupled to the hinge coupling protrusion of the pair of supporting plates as they are extended in such a manner that the interval between the two facing link bars becomes smaller gradually; and a tension spring which is connected between a fixing axis connected across the wheel frame and the supporting axis of the wheel supporting unit.

3. The inline skate of claim 2, wherein the first and second elastic supporting means further comprises a plurality of hinge coupling protrusions formed on the outer surface of the supporting plates at a predetermined interval so as to be selectively coupled to one end of the link bars.

4. The inline skate of claim 1, wherein the leaf springs are formed in the shape of a pleat sheet with its outer surface forming a continuous flexure.

5. The inline skate of claim 1, wherein the first and second elastic supporting means further comprises:

a plurality of coupling holes formed at a predetermined interval on the outer surface of the front end of the leaf springs so that they can be selectively coupled between the facing leaf springs by means of a coupling member; and a pair of wheel fixing plates arranged on the front end of the leaf springs for adjusting stiffness of the leaf springs, the axle shaft being connected in parallel across the gap between the wheel fixing plates.

6. The inline skate of claim 1, wherein an open cut groove is formed at one lateral surface of the leaf springs to thus offer higher flexibility to the leaf springs.

7. The inline skate of claim 1, wherein the pressing means comprises one or plural middle wheels which have a sectional shape of a smaller curvature so that they have the same diameter as the front and rear wheels and have a shaper curve than the outer and inner curved surfaces of the front and rear wheels and which are fixed and supported on the wheel frame wherein their axle shalt is located on the same horizon as the axle shaft of the front and rear wheels.

8. The inline skate of claim 1, wherein the pressing means comprises:

one or plural middle wheels which are fixed and supported on the wheel frame wherein they have a sectional shape of the same diameter and same curvature as the front and rear wheels and their axle shaft is located on the same horizon as the axle shaft of the front and rear wheels; and a first elastic member for providing elasticity so as to make the middle wheel vertically movable within a predetermined range.

9. The inline skate of claim 1, wherein the pressing means comprises one or plural middle wheels which are fixed and supported on the wheel frame wherein that they have a sectional shape of smaller diameter than and the same curvature as the front and rear wheels and their axle shaft is located on the same horizon as the axle shaft of the front and rear wheels.

10. The inline skate of claim 1, wherein the pressing means comprises one or plural middle wheels which are fixed and supported on the wheel frame wherein they have a sectional shape of the same diameter and same curvature as the front and rear wheels and their axle shaft is located higher than the axle shaft of the front and rear wheels.

11. The inline skate of claim 1, wherein the pressing means pressing the front and rear wheels to be rotatable comprises:

a hinge portion which is provided on the lower end of the rear end portion of each of the leaf springs so that the leaf springs each can be vertically rotated relative to the wheel frame;

a second elastic member which is provided on the upper end of the rear end portion of the leaf springs for providing elasticity to the leaf springs so that the leaf springs can be vertically rotated around the hinge portion; and a plurality of middle wheels which are fixed and supported on the wheel frame wherein they have a sectional shape of the same diameter and same curvature as the front and rear wheels and their axle shaft is located on the same horizon as the axle shaft of the front and rear wheels with the leaf springs each being kept parallel.

12. The inline skate of claim 11, wherein a compression force is applied to the second elastic member in a state that the leaf springs each are kept parallel and the axle shaft of the front, rear and middle wheels is located on the same horizon.

* * * * *